United States Patent [19]

Wen-Ying

[11] Patent Number: 4,737,616

[45] Date of Patent: Apr. 12, 1988

[54] MULTI-FUNCTION PORTABLE ELECTRIC ROOM HEATER HAVING A REMOVABLE HEATING CARTRIDGE

[76] Inventor: Lee Wen-Ying, No. 5, Lane 50, Chiao An Street, Taipei, Taiwan

[21] Appl. No.: 862,253

[22] Filed: May 12, 1986

[51] Int. Cl.[4] ..... H05B 3/00; H05B 1/00; F24H 3/04; F24H 9/00

[52] U.S. Cl. ..... 219/370; 219/360; 219/361; 219/362; 219/364; 219/366; 219/472; 219/473; 261/139; 261/142

[58] Field of Search ..... 219/359–382, 219/473; 261/139, 142; 219/472

[56] References Cited

U.S. PATENT DOCUMENTS

| | | | |
|---|---|---|---|
| 2,025,216 | 12/1935 | Opitz | 219/473 X |
| 2,062,042 | 11/1936 | Sargent | 261/142 X |
| 2,109,279 | 2/1938 | Soverhill | 219/370 |
| 2,544,189 | 3/1951 | Tankersley | 219/362 X |
| 2,628,083 | 2/1953 | Rense | 261/139 X |
| 2,638,644 | 5/1953 | Rauhut | 261/142 X |
| 2,839,657 | 6/1958 | Mast | 219/370 X |
| 3,176,117 | 3/1965 | Knoll et al. | 219/370 |

*Primary Examiner*—Anthony Bartis
*Attorney, Agent, or Firm*—Burns, Doane, Swecker & Mathis

[57] ABSTRACT

A multifunction portable electric room heater has an outer housing provided with an air inlet and air outlet and encloses a removable unit including a hollow base containing electrical power supply circuitry and supporting on its upper side a heating cartridge holder and a fan having an electrical motor connected for energization to the power supply circuitry. A heating cartridge carrying a PTC electric resistance heating element is removably inserted into the holder through registering slots in the housing wall and holder for heating the air circulated by fan through the holder and the heating cartridge from the air inlet to the air outlet. Cooperating electrical connectors are provided on the base and heating cartridge for detachably connecting the heating element to the power supply circuitry in the base. The heating cartridge is removable for cleaning and repair and may be replaced by cartridges similar in shape and carrying an air filter or an aromatic diffuser so that the apparatus may be used to filter room air or discharge a fragrant aroma into the room.

11 Claims, 4 Drawing Sheets

MULTI-FUNCTION PORTABLE ELECTRIC ROOM HEATER HAVING A REMOVABLE HEATING CARTRIDGE

BACKGROUND

The present invention relates to a cartridge-type room heater, and more particularly, to a box-type room fan heater.

In a conventional box-type heating air fan or a room heater, as it is known, the heating portion is generally mounted within the outer housing body at a place between the fan and the air guide sheet or the guard mesh. The construction of such device is complicated. If however, dismantling of the fan or heater for repairing, maintaining or cleansing purpose becomes necessary, it would be very troublesome and would require the air guide sheet or the guard mesh at the front of the box body be removed before the heating facility portion could eventually be dismantled. Furthermore, during the dismantling of the fan or the heater, it is generally necessary to unscrew one by one the several binding screws. Working in such limited space inside the body of the box would also be very inconvenient. Also, during the summertime when the heating portion is not in use and it is desired that the fan be used only to circulate air, the most that one could do would be to turn off the electric current to the heater. The heating facility itself would still be lying idly inside the box body, and would restrict the volume of air flow. After a long time, dust would accumulate on the fan and would adversely affect the volume and power of air being discharged by the fan. Also, such a conventional heating fan can be used for a single purpose only; if the fan is to be employed as an air filter, the construction in the device would then tend to be even more complicated and this would result in the cost being greatly increased.

OBJECTS OF THE INVENTION

In view of the above, the present inventor has devised a novel cartridge-type room heater in accordance with the invention.

Accordingly, the principal object of the present invention is to provide a multifunction cartridge-type room heater including a cartridge-type heating component, the heating component of which is capable of being removably inserted in a holder provided inside the box body to effect electrical connection therebetween and capable of being withdrawn from the box body for cleansing, repairing and maintaining purposes.

A next object of the present invention is to provide a multi-function cartridge-type room heater with the cartridge-type heating component capable of being withdrawn from the box body and kept separately when the heating is not in use, whereupon the remaining components are capable of being utilized as an ordinary box-type fan or circulating fan.

Another object of the present invention is to provide a multifunction cartridge-type room heater capable of having an air filter component formed into a cartridge capable of replacing the afore-said cartridge-type heating component in the holder whereby the apparatus can be used as a room air filter fan.

A further object of the present invention is to provide a multifunction cartridge-type room heater capable of having a cartridge-type aromatic component inserted in substitution for the cartridge-type heating component or the air filter component in the holder whereby the apparatus can be used as an aromatic air fan.

A still further object of the present invention is to provide a multifunction cartridge-type room heater which is simple in construction, low in cost and simple and convenient in cleansing and maintenance, and capable of performing a variety of functions.

SUMMARY OF THE INVENTION

These objects are achieved by the present invention which relates to a cartridge-type room heater. The heater comprises an outer housing comprising front and rear sides with front and rear openings therein. A top side and upright sides interconnect the front and rear sides. A slot is formed in one of the top and upper sides. A main machine is removably mountable in the outer housing. The main machine includes a hollow base in the housing at the bottom thereof. The base contains a main electric circuit having first electrical connector means. A cartridge holder is mounted on an upper side of the base and includes front and rear sides and a top side and upright sides interconnecting the front and rear sides of the holder. The front and rear sides of the the holder include front and rear openings communicating respectively with the front and rear openings in the outer housing. One of the top and upright sides of the holder has an opening aligned with the slot in the outer housing. An electric fan is mounted on the upper side of the base and is arranged to produce a flow of air through the heater from the rear opening of the outer housing, through the front and rear openings of the cartridge holder, and out the front opening of the outer housing. The fan is electrically connected to a main electric circuit. A cartridge is removably inserted in the holder through a slot in the outer housing and the opening in the holder. The cartridge comprises front and rear openings communicating respectively with the front and rear openings in the holder. Electrical heating elements are arranged in the cartridge to heat air passing through the outer housing. The cartridge includes second electrical connector means which are connected to the heating elements and are detachably connected to the first electrical connector means. Front and rear guards are detachably connected adjacent the front and rear openings, respectively, of the outer housing.

BRIEF DESCRIPTION OF DRAWINGS

Other objects and features of the present invention will become apparent from the following more particular description of the preferred embodiments of the invention, taken in conjunction with the accompanying drawings wherein.

DETAILED DESCRIPTION

Figure 1:
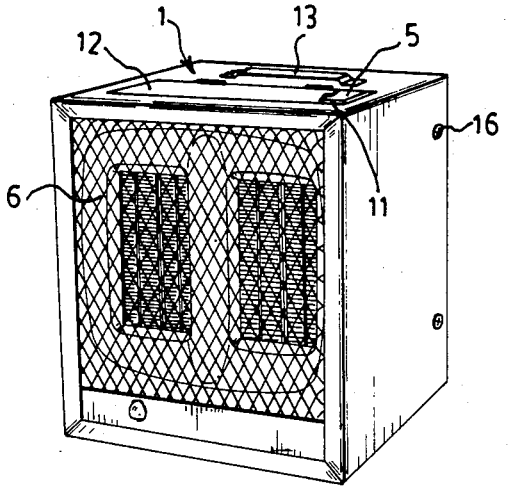
FIG. 1 is a perspective view of a cartridge-type fan heater according to the invention.
Figure 2:
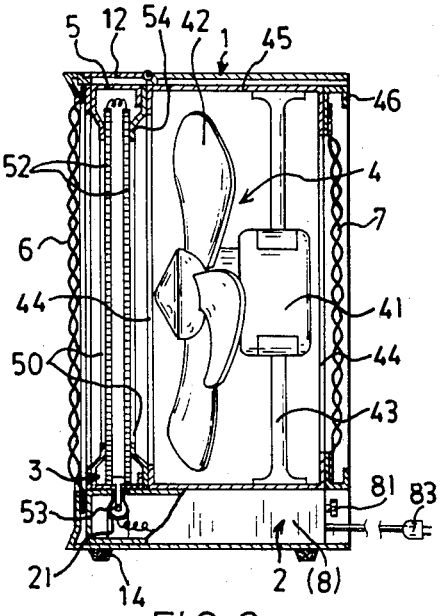
FIG. 2 is a sectional view of the cartridge-type fan heater shown in FIG. 1.
Figure 3:
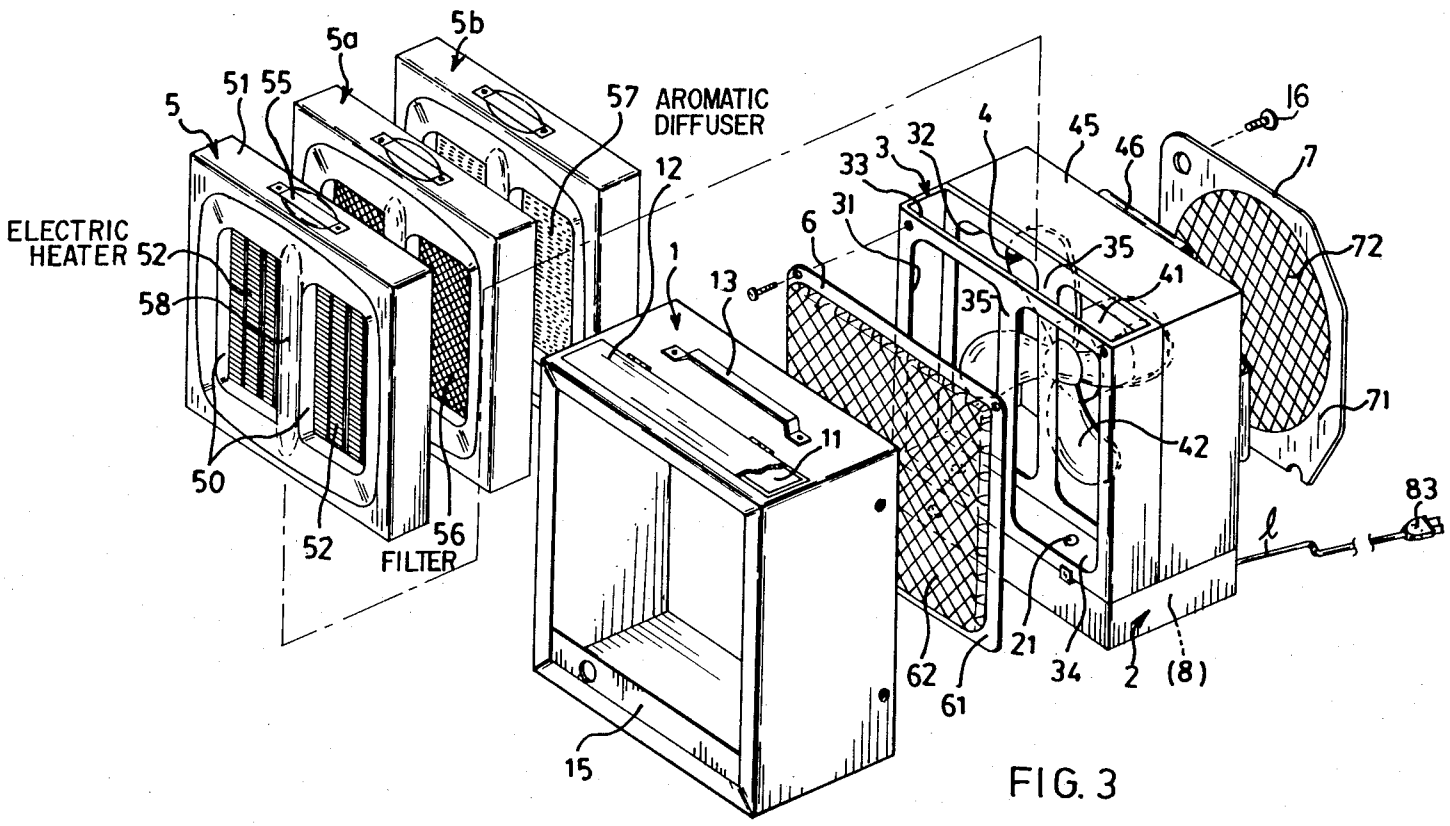
FIG. 3 is an exploded view in perspective of the cartridge-type fan heater in accordance with the invention.

The cartridge type room heater according to the present invention, as illustrated in FIGS. 1 to 3, comprises mainly a case-like outer housing 1 opening at both the front and the rear sides. A base 2 is received in that outer housing 1, and a cartridge holder 3 is vertically disposed on the upper front portion of the base 2. The cartridge holder is open at both the front and the back and acts as an air conduit. An electric fan 4 is fixedly mounted on the back upper portion of the base 2 and is spaced-apart and opposite to the cartridge holder 3. A cartridge 5 is configured for one-step insertion into the holder 3. A front fan guard 6 is mounted between the front of the cartridge holder 3 and the inside of the front opening of the outer housing 1. A rear fan guard 7 overlies the opening of a rear-end plate of the fan 4. A control circuit 8 is fitted inside the base 2.

The outer housing 1 of the case is open at both the front and the back, and is provided on the front of its top face with a transverse, rectangular slot 11 for insertion of the cartridge and a lid 12 which covers the slot 11. A carrying handle 13 is mounted on the top face of the outer housing 1. On the bottom of the housing is a plurality of feet 14 (in this embodiment there are four in number).

The base 2, which can be pushed in and drawn out from the rear opening of the outer housing 1, is received in the inside bottom portion of the housing 1 until the front of the base 2 abuts a folded-up edge 15 at the front opening of the outer housing 1. The inside of the base 2 houses the control circuit 8 described hereinafter. On the front top face of the base where the cartridge holder 3 is located is provided a pair of receptacles 21 for electrical connection. On the rear terminal face of the base 2 is fitted a switch 81 for the electric fan and also constituting a partial power supply to the aforesaid control circuit 8. Also on the rear terminal face is a switch 82 for the electrical heating, and a base 22 in which a hole for a power line L is formed and from which extends the power line L with a plug 83 connected thereto.

The cartridge holder 3 is securely mounted on the front portion of the base 2 and is provided at the front and the back thereof with openings 31, 32 respectively. On both the top and the bottom faces, the cartridge holder 3 is further provided with a pair of rectangular openings 33, 34 which must lie beneath the aforesaid cartridge insertion slot 11 since the holder 3 is used for the receipt of the cartridge 5, and the electrical connector receptacles 21 on the base 2 are located within the opening 34 at the bottom of the holder 3. Furthermore, in the center of each of the symmetrically arranged openings 31, 32 is a vertical bar 35 which divides the opening 31, 32 into two halves and serves to strengthen the cartridge holder 3.

The electric fan 4 comprises a motor 41 and a fan 42, and is mounted by an appropriate fastening means 43 on a fixed case 45 having an opening 44 in the center. This case 45 is securely mounted on the upper rear portion of the base 2 and lies opposedly to the afore-said cartridge holder 3. The fixed case 45 is joined to the cartridge holder 3 to form therewith a single unit. On the outside face of the fixed case 45 there is at least one (in this embodiment it is three) L-shaped gripping portion 46.

The cartridge 5 includes a thin cartridge body 51 capable of being conveniently inserted in the cartridge holder 3 through the opening 33 on the upper side of the holder. The body 51 is provided with a plurality of openings 50 on its front and back sides. On the inside of this cartridge body 51 is mounted a plurality of electrical heating elements 52 which closes the openings 50 on the front and the back sides described above and has a ventilation effect. In the present embodiment, the heating elements 52 are formed of PTC elements, however, the heating elements could be composed of heating coils. Such heating elements 52 are electrically interconnected in the cartridge body 51 by means of conductors or wires and the input terminal 53 of this electrical connection projects out as a plug-in type contact point on the bottom face of the cartridge body 51. Upon inserting the cartridge 5 completely into the holder 3, this input terminal 53 will be placed in appropriate contact with the socket 21 in that holder 3 so as to complete an electric circuit. One side 54 (i.e., the back side in the present embodiment) of the cartridge body 51 is detachable thereby facilitating the installation of the heating elements 52. A hand gripping means 55 is mounted on the upper side of the cartridge body 51 to facilitate its withdrawal from the holder 3.

The front guard 6 comprises a frame 61 with an opening at the center and a mesh 62 fitted to the frame 61. This front guard 6 is removably mounted on the front of the holder 3 such that the slightly forward-bulging mesh 62 enters the opening at the front of the outer housing 1. The rear guard 7, on the other hand, is removably mounted on the holder behind the fixed case 45. The rear guard 7 comprises a frame 71 with an opening at the center and a mesh 72 fitted in the opening of the frame 71.

The base 2, holder 3, the electric fan 4, the cartridge 5, the front guard 6 and the rear guard 7 together form a unit which can be conveniently inserted through the opening at the back of the outer housing 1 into the housing. In combining this unit with the outer housing 1 to form a single body, appropriate fastener 16 such as screws may be used and may extend through a rear side face of the outer housing 1.

Figure 4:
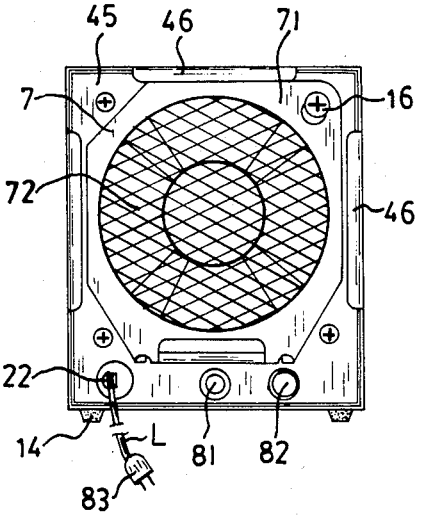
FIG. 4 is a rear view of the cartridge-type fan heater.
Figure 5:
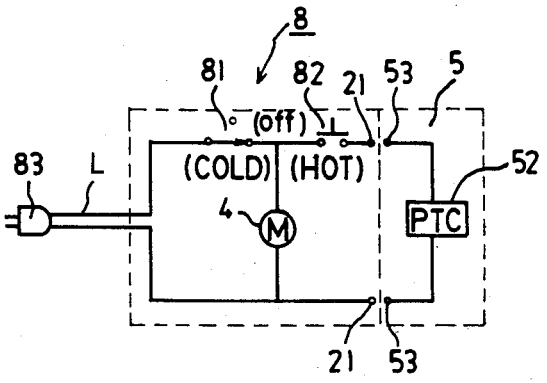
FIG. 5 is a circuit diagram in accordance with the invention.

There is shown in FIG. 5 one embodiment of the electric circuit 8 according to the present invention, in which 83 is the plug, L the power line extending from the base 22 (see FIG. 4), 81 the fan switch, 82 the electric heating thermoregulating switch, 4 the fan, 21 the power receptacle, 53 the electric terminal and 52 the heating element. The above-mentioned elements 81, 82, 4 and 21 are mounted, respectively, in the base 2, whereas the elements 52 and 53 are located, respectively, inside the cartridge 5, it being preferable that a switch capable of controlling temperature is used for the electric heating switch 82 described above.

In utilizing the room heater of the present invention, the plug 83 is first inserted in an AC connector receptacle. Upon turning-on the fan switch 81 the electrical fan 4 will rotate and suck air through the rear guard 7. That air will be blown forward through the cartridge 5 and the front guard 6. At this time, the air so blown out is cold and when the heating switch 82 is next turned on, the heating elements 52 turns hot immediately and hence, the cold air sucked in by the electric fan 4 will, on passing through the holder 3 and the cartridge 5, absorb heat and turn warm. Control of the air temperature can now be effected by regulating the afore-said temperature control 82. In the event that the supply of warm air is no longer required, the temperature control (heating switch) 82 can be turned off, whereupon the heater will turn into an ordinary box-type electric fan.

The room fan heater may perform functions other than heating by providing alternately usable cartridges 5*a*, 5*b* dimensioned and constructed the same as the cartridge 5. Those cartridges 5*a*, 5*b* may be provided with material or filter gauze 56 and aromatic-soaked fragrance sheets or leaf shaped aromatic 57 for example. When necessary, these cartridges 5*a*, 5*b* may replace the heater cartridge 5 and on being inserted in the holder 3 will render the electric fan capable of filtering the air or discharging a fragrant aroma. Owing to the simple action with which the cartridges 5, 5*a*, 5*b* can be inserted in or withdrawn from the holder 3, the electric fan heater of the present invention is therefore conveniently and practically useful. Instead of providing separate filter and fragrance cartridges 5*a*, 5*b* the filter material or filter gauze, such as filter elements 56, and aromatic sheets, such as aromatic elements 57, can be provided as replacements for the heating elements 52 in the cartridge 5.

Figure 6:
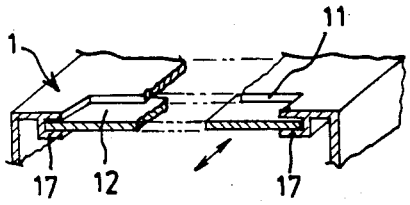
FIG. 6 is a schematic view of the outer housing together with the cover plate in another embodiment according to the invention.
Figure 7:
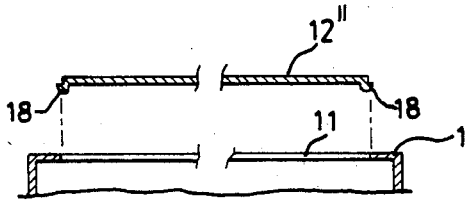
FIG. 7 is fragmentary exploded sectional view of the outer housing together with the cover plate of still another embodiment according to the invention.

FIG. 6 illustrates a further embodiment according to the present invention in which a cover plate 12' is placed beneath the insertion slot 11 of the outer housing 1. This cover plate 12' is slidable on slideway portions of the insertion slot 11 for closing and opening the slot 11. In FIG. 7, there is shown still another embodiment in which a cover plate 12'' is capable of attachment over the insertion slot 11 by the holding pawls 18.

Figure 8:
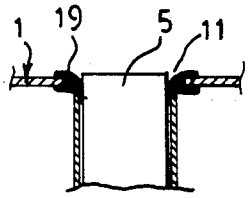
FIG. 8 is a fragmentary sectional view of the upper end of the cartridge component according to another embodiment of the invention.

The handle 13 can be of any conventional type or eliminated altogether. In still another embodiment as depicted in FIG. 8, there is shown the outer housing 1, the insertion slot 11 thereof having no cover plate 12. Under this condition, it is preferable that the top face of the cartridge 5 be arranged in the same level as the top face of the outer housing 1. In order to prevent air from inside the outer housing 1 from escaping out through spaces in the periphery of the insertion slot 11, the surrounding edges of the slot 11 are fitted with flexible sealing bodies 19 like rubber.

The guards 6 and 7 in the fan heater of the present invention can be of any appropriate shape and can be arranged in any suitable way.

Furthermore, the front and rear openings 50 of the cartridge 5 are provided at the center with vertical reinforcing rods 58 integrally formed with the cartridge body 51. However, the rod 58 may be of a cross-shape or any other shape, and could be eliminated if desired.

Figure 9:
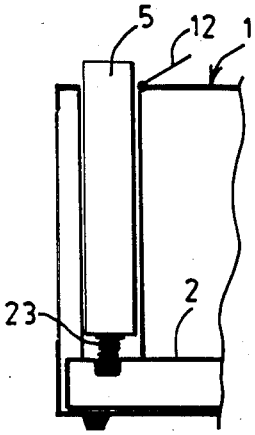
FIG. 9 is a fragmentary schematic view of a cartridge holder according to the invention.

In order to facilitate withdrawal of the cartridge 5, a spring 23 is mounted, in a manner as shown in FIG. 9, on the base 2 so that the cartridge 5 will always tend to move upward under the urging force of the spring. In this way, when the cover plate 12 is properly closed the spring 23 will compress itself and, when the cover plate 12 is opened up, this spring 23 will expand and quickly raise the cartridge upward a little.

Moreover, the two aforesaid electrical connector receptacles 21 mounted on the base 2 may be longitudinally arranged in a row or they may also be arranged in a staggered manner, and these receptacles 21 act not only as electrical connecting terminals but act as positioning devices for the cartridge.

Figure 10:
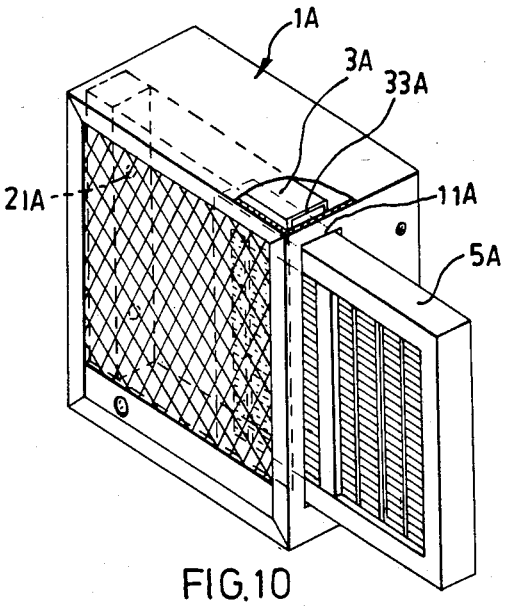
FIG. 10 is a schematic view of the cartridge-type heater in another embodiment of the invention, showing the cartridge being laterally inserted in the holder.

FIG. 10 depicts another embodiment of the room heater according to the present invention. The insertion slot 11A for the cartridge is provided on one of the two lateral sides of the outer housing 1A. In line with this insertion slot, a corresponding side rectangular opening 33A is formed on one side of the cartridge holder 3A, whereas on the opposite side thereof are mounted two electrical connector receptacles 21A so that the cartridge 5A can be laterally inserted in the holder 3A through the opening 33A.

Figure 11:
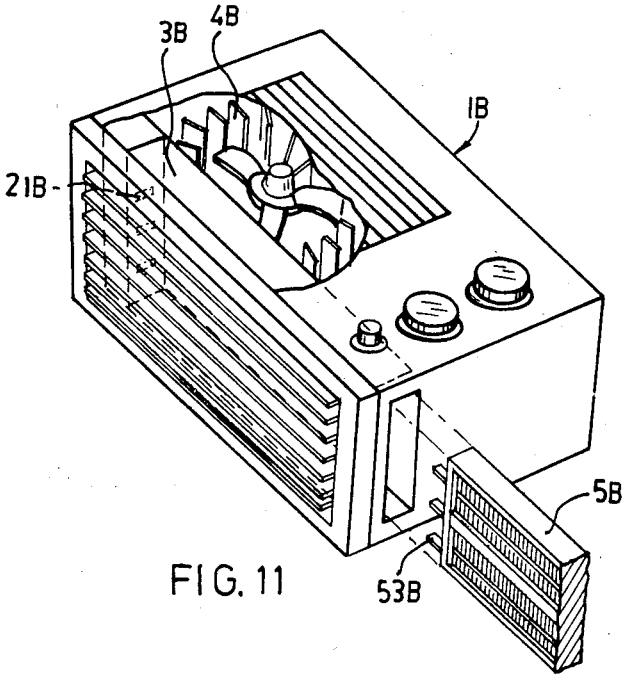
FIG. 11 is a schematic view of one further embodiment according to the invention, showing the fan being horizontally positioned and the lateral insertion of the cartridge.

In still another embodiment of the present invention shown in FIG. 11, the electric fan 40 is horizontally placed, and the cartridge 5B has a plurality of prongs 53B and is capable of being transversely inserted from the lateral side in the holder 3B to be connected to the electrical connector receptacles 21B.

Owing to the presence of a cartridge type construction as above, this room fan heater of the invention is not only readily convertible into a general electric fan or an air filter or a aromatic diffuser, but is very easy to repair, cleanse and maintain. This novel fan heater is therefore practically useful.

Finally, it will be understood that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

I claim:

1. A cartridge-type room heater comprising:

an outer housing comprising front and rear sides with front and rear openings therein, a top side and upright sides interconnecting said front and rear sides, and a slot formed in one of said top and upright sides, a main machine removably mounted in said outer housing, including:

a hollow base disposed in said housing at the bottom thereof, said base containing a main electric circuit having first electrical connector means, a cartridge holder mounted on an upper side of said base and including front and rear sides, and a top side and upright sides interconnecting said front and rear sides of said holder, said front and rear sides of said holder including front and rear openings communicating respectively with said front and rear openings in said outer housing, one of said top and upright sides of said holder having an opening aligned with said slot in said outer housing, and an electric fan mounted on said upper side of said base and arranged to produce a flow of air through the heater from said rear opening of said outer housing, through said front and rear openings of said cartridge holder, and out said front opening of said outer housing, said fan being electrically connected to said main electric circuit, a cartridge removably inserted in said holder through said slot in said outer housing and said opening in said holder, said cartridge comprising:

front and rear openings communicating respectively with said front and rear openings in said holder, electrical heating elements arranged to heat air passing through said outer housing, and second electrical connector means connected to said heating elements and detachably connected to said first electrical connector means, and front and rear guards detachably connected adjacent said front and rear openings, respectively, of said outer housing.

2. A cartridge-type room heater according to claim 1, wherein said front and rear guards are detachably coupled to said main machine.

3. A cartridge-type room heater according to claim 1, wherein said fan is mounted within a casing disposed on said upper side of said base.

4. A cartridge-type room heater according to claim 3, wherein said casing includes a lifting handle.

5. A cartridge-type room heater according to claim 1 including a cover mounted on said outer housing for covering and uncovering said slot.

6. A cartridge-type room heater according to claim 1, wherein said slot is formed in said top side of said outer housing.

7. A cartridge-type room heater according to claim 1, wherein said first electrical connector means comprises receptacles, and said second electrical connector means comprises plug-in members removably received in said receptacles.

8. A cartridge-type room heater according to claim 1, wherein said base is provided with separate switches for activating said heating elements and fan, respectively.

9. A cartridge-type room heater according to claim 1 including spring means arranged to act between said cartridge and said base for biasing said cartridge out of said outer housing.

10. A cartridge-type room heater comprising:

an outer housing comprising:

front and rear sides with front and rear openings therein, a top and upright sides interconnecting said front and rear sides, and a slot formed in one of said top and upright sides, a main machine removably mounted in said outer housing, including:

a hollow base disposed in said housing at the bottom thereof, said base containing a main electric circuit, a cartridge holder mounted on an upper side of said base and including front and rear sides, and a top side and upright sides interconnecting said front and rear sides of said holder, said front and rear sides of said holder including front and rear openings communicating respectively with said front and rear openings in said outer housing, one of said top and upright sides of said holder having an opening aligned with said slot in said outer housing, said cartridge holder including first electrical connector means connected to said main circuit, and an electric fan mounted on said upper side of said base and arranged to produce a flow of air through the heater from said rear opening of said outer housing, through said front and rear openings of said cartridge holder, and out said front opening of said outer housing, said fan being electrically connected to said main electric circuit, a cartridge removably inserted in said holder through said slot in said outer housing and said opening in said holder, said cartridge comprising:

front and rear openings communicating, respectively, with said front and rear openings in said holder, electrical heating elements arranged to heat air passing through said outer housing, and second electrical connector means connected to said heating elements and detachably connected to said first electrical connector means, and front and rear guards detachably connected adjacent said front and rear openings, respectively, of said outer housing.

11. A cartridge-type room heater according to claim 10, wherein said first electrical connector means are disposed in said upright side of said cartridge holder, said second electrical connector means disposed in said upright side of said cartridge.

* * * * *